US008348601B2

(12) United States Patent
Hayashi et al.

(10) Patent No.: US 8,348,601 B2
(45) Date of Patent: Jan. 8, 2013

(54) VARIABLE NOZZLE MECHANISM

(75) Inventors: Noriyuki Hayashi, Nagasaki (JP); Yasuaki Jinnai, Sagamihara (JP); Hiroshi Suzuki, Sagamihara (JP); Yuki Ishii, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 299 days.

(21) Appl. No.: 12/671,163

(22) PCT Filed: Oct. 2, 2008

(86) PCT No.: PCT/JP2008/067963

§ 371 (c)(1),
(2), (4) Date: Feb. 22, 2010

(87) PCT Pub. No.: WO2009/078211

PCT Pub. Date: Jun. 25, 2009

(65) Prior Publication Data

US 2010/0202874 A1 Aug. 12, 2010

(30) Foreign Application Priority Data

Dec. 14, 2007 (JP) ..... 2007-323553

(51) Int. Cl.
*F01D 17/16* (2006.01)

(52) U.S. Cl. ..... 415/160; 415/165

(58) Field of Classification Search ..... 415/151, 415/160, 162, 163, 164, 165
See application file for complete search history.

(56) References Cited

U.S. PATENT DOCUMENTS

| | | | | |
|---|---|---|---|---|
| 6,471,470 | B2 * | 10/2002 | Yoshimura et al. | 415/160 |
| 7,490,470 | B2 * | 2/2009 | Jinnai et al. | 60/602 |
| 7,670,107 | B2 * | 3/2010 | Barthelet et al. | 415/160 |
| 2006/0179838 | A1 | 8/2006 | Nakagawa et al. | |
| 2008/0031728 | A1 * | 2/2008 | Sausse et al. | 415/160 |

FOREIGN PATENT DOCUMENTS

| | | | |
|---|---|---|---|
| JP | 2000-199433 | A | 7/2000 |
| JP | 2004-84545 | A | 3/2004 |
| JP | 2004-270472 | A | 9/2004 |
| JP | 2006-161811 | A | 6/2006 |
| JP | 2006-220092 | A | 8/2006 |

* cited by examiner

*Primary Examiner* — Edward Look
*Assistant Examiner* — Ryan Ellis
(74) *Attorney, Agent, or Firm* — Birch, Stewart, Kolasch & Birch, LLP

(57) ABSTRACT

When changing a nozzle blade angle by rotating a drive ring, a contact load generated between an inner circumferential surface of the drive ring and an outer circumferential surface of a mount can be reduced, allowing the drive ring to rotate smoothly and reducing the amount of wear and a driving force. It is also possible to reduce an impact force, such as engine vibrations, generated at the drive ring when an external force acts, reducing the risk of damage. A plurality of notches (19) are provided at an inner rim of the drive ring (14), and, among inner circumferential surfaces (14*a*, 14*b*, 14*c*, 14*d*, 14*e*, 14*f*, 14*g*, and 14*h*) located between the notches (19), when a driving force for rotating the drive ring (14) is applied, the inner diameters of the inner circumferential surfaces (14*e*, 14*f*, 14*g*, and 14*h*) where the contact load with the outer circumferential surface of a mount becomes large are made larger than the outer diameter of the outer circumferential surface.

8 Claims, 7 Drawing Sheets

VARIABLE NOZZLE MECHANISM

BACKGROUND OF THE INVENTION

1. Field of the Invention

The present invention relates to a variable nozzle mechanism that has a function of changing a flow speed of combustion gas (fluid) into a turbine rotor by rotating a nozzle to change a nozzle blade angle and that is used in variable geometry turbines constituting a variable geometry turbocharger (for example, exhaust-gas turbine-supercharger).

2. Description of Related Art

A known variable nozzle mechanism used for variable geometry turbines is disclosed, for example, in Patent Documents 1 and 2.

Patent Document 1: Japanese Unexamined Patent Application, Publication No. 2006-161811

Patent Document 2: Japanese Unexamined Patent Application, Publication No. 2004-270472

BRIEF SUMMARY OF THE INVENTION

In the invention disclosed in the above-described Patent Documents, the inner diameter of a drive ring is made slightly larger than the outer diameter of a mount (supporting member).

A turbocharger receives vibrations from an engine because it is mounted on an engine base. Since smooth rotation of the drive ring is required, a gap is provided between the drive ring and surrounding parts, such as a mount, when assembling the drive ring. However, when the drive ring receives vibrations from outside, it collides with the surrounding parts contacting with the drive ring, with a gap therebetween, generating an impact load. If the vibrations of the engine become large, the contact load is large, resulting in damage to the drive ring in some cases.

The impact load applied to the drive ring is related to the mass of the drive ring; therefore, minimizing the weight of the drive ring is effective in reducing the impact load. As one of the methods for minimizing the weight of the drive ring, a method for providing a notch at the inner diameter of the drive ring may be employed. However, when providing the notch at the inner diameter, the processing accuracy of the inner diameter may be deteriorated. If the processing accuracy of the inner diameter is not sufficient, when a force for rotating the drive ring is applied and when the drive ring moves by an amount equal to a gap between the mount and the drive ring, the inner circumferential surface of the drive ring may pinch the outer circumferential surface of the mount when a wedge is driven therebetween. As a result, a large contact force may be generated between the drive ring and the mount even when a small driving force for rotating the drive ring is applied. Accordingly, an excessive frictional resistance due to rotation is generated, possibly causing a problem of difficulty in rotation. This often happens when two surfaces contact at an angle with respect to the driving force.

The present invention has been conceived in light of the circumstances described above, and an object thereof is to provide a variable nozzle mechanism capable of reducing an increase in a contact load between the inner circumferential surface of the drive ring and the outer circumferential surface of the mount when changing a nozzle blade angle by rotating a drive ring, allowing the drive ring to rotate smoothly, and preventing an increase in the amount of wear and driving force due to an increased contact force.

In order to solve the problems described above, the present invention employs the following solutions.

A variable nozzle mechanism according to the present invention changes the flow speed of fluid into a turbine rotor by rotating a nozzle to change a nozzle-blade angle and has a drive ring that is supported by a mount secured to a bearing housing configured to support the turbine rotor and that rotates relative to the mount while some inner circumferential surfaces abut against a portion of an outer circumferential surface of the mount, wherein a plurality of notches in a circumferential direction are provided at an inner rim of the drive ring, and among the inner circumferential surfaces located between the notches, when a driving force for rotating the drive ring is applied, an inner diameter in a region where a contact load with the outer circumferential surface tends to become large is made larger than an inner diameter of other inner circumferential surfaces.

In the variable nozzle mechanism described above, among the inner circumferential surfaces of the drive ring, the region where the contact load with the outer circumferential surface tends to become large is a region that passes through the center of the inner circumferential surfaces and that does not intersect with a line substantially parallel with a line of action of the driving force for rotating the drive ring, as well as a region that passes through the center of the inner circumferential surfaces and that does not intersect with a line substantially orthogonal to the line of action of the driving force for rotating the drive ring, that is, among the inner circumferential surfaces, a region where a tangent line in the circumferential direction forms an inclined angle with respect to the direction in which the driving force acts.

With the variable nozzle mechanism according to the present invention, when the drive ring rotates, it is possible to reduce the contact load generated between the inner circumferential surfaces of the drive ring and the outer circumferential surface of the mount, allowing the drive ring to rotate more smoothly and reducing the amount of wear and the driving force. More specifically, longer life (extended life) of the drive ring and the mount is possible, and the reliability of the entire mechanism (variable nozzle mechanism) can be enhanced.

In addition, because a plurality of notches are provided at the inner rim of the drive ring in the circumferential direction, the weight of the drive ring can be minimized, reducing the risk of damage when an external force acts.

In the variable nozzle mechanism described above, a thick portion for increasing a plate thickness is preferably provided in the region where the contact load with the outer circumferential surface tends to become large.

With this variable nozzle mechanism, by increasing the plate thickness in the region where a contact load with the outer circumferential surface of the mount tends to become large and by increasing the contact area with the outer circumferential surface of the mount, it is possible to reduce the contact load per unit area and the depth of wear of the drive ring. Accordingly, longer life (extended life) of the drive ring is possible, and the reliability of the entire mechanism (variable nozzle mechanism) is further improved.

In addition, one object of the variable nozzle mechanism according to the present invention is to prevent damage to the drive ring due to the excessive vibrations of the engine. The drive ring is damaged when excessive stress is applied. Because the stress also depends on the plate thickness of the drive ring, damage is effectively prevented by increasing the plate thickness within a range where the weight of the drive ring is not too heavy.

Because portions where the inner diameter of the inner circumferential surfaces of the drive ring is made large do not directly contact with the mount, high processing accuracy of these inner circumferential surfaces is not required. Accordingly, by locally providing the thick portion by, for example, bending the plate, the stress applied to the drive ring is reduced, and the reliability of the drive ring in terms of damage is improved.

In the variable nozzle mechanism described above, the thick portion for increasing the plate thickness is preferably provided in a peripheral region of a portion to which the driving force is applied.

With this variable nozzle mechanism, by increasing the plate thickness of portion to which the driving force for rotating the drive ring is applied and the contact area contacting with a member that transmits the driving force, it is possible to reduce the contact load per unit area and the depth of wear of the portion contacting with the member that transmits the driving force. Accordingly, longer life (extended life) of the drive ring is possible, and the reliability of the entire mechanism (variable nozzle mechanism) is further improved.

In the variable nozzle mechanism described above, a protruding portion that abuts against a head portion of a stopper pin for preventing the drive ring from dropping off from the mount is preferably provided in the region where the contact load with the outer circumferential surface tends to become large.

With this variable nozzle mechanism, a gap between the drive ring and both the mount and the stopper pin can be reduced by providing the protruding portion, thus reducing an impact force generated when an external force, such as engine vibrations, acts and reducing the risk of damage to the drive ring.

In the variable nozzle mechanism described above, an impact absorbing member is preferably provided between the head portion of the stopper pin and both the drive ring and the mount.

With this variable nozzle mechanism, the protruding portion does not have to be processed with, for example, extrusion molding, thus simplifying the production process and reducing production costs. In the same manner as for providing the protruding portion, it is possible to reduce the impact force generated when the external force, such as engine vibrations, acts and to reduce the risk of damage to the drive ring.

In the variable nozzle mechanism described above, surface hardening is preferably performed on a front surface of the protruding portion and/or the entire back surface of the head portion of the stopper pin.

With this variable nozzle mechanism, scratches can be prevented from being generated on the front surface of the protruding portion and/or the back surface of the head portion.

In addition, because wear resistance of the drive ring and the stopper pin can be improved, longer life (extended life) of the drive ring and the stopper pin is possible, and the reliability of the entire mechanism (variable nozzle mechanism) is further improved.

In the variable nozzle mechanism described above, the plurality of notches or a plurality of through holes for receiving lever plates that manipulate the nozzle blade angles of the nozzles are preferably provided at the outer rim of the drive ring in the circumferential direction.

With this variable nozzle mechanism, the weight of the drive ring and the entire mechanism (variable nozzle mechanism) can be minimized.

In addition, the weight of the drive ring is minimized and the drive ring rotates more smoothly, thus reducing the driving force for driving the drive ring and reducing the running costs.

A variable geometry turbocharger according to the present invention includes the variable nozzle mechanism capable of reducing the risk of damage to the drive ring due to an external force and the contact load generated between the inner circumferential surfaces of the drive ring and the outer circumferential surface of the mount when the drive ring rotates, allowing the drive ring to rotate more smoothly, and reducing the amount of wear and the driving force.

With the variable geometry turbocharger according to the present invention, because the maintenance or replacement interval of the variable nozzle mechanism can be extended, the maintenance cost of the entire device (a variable geometry turbine and the variable geometry turbocharger) can be reduced.

With the variable geometry turbine and the variable geometry turbocharger including the variable nozzle mechanism according to the present invention, the reliability of the entire device is improved according to the improvement of the reliability of the variable nozzle mechanism.

With the variable geometry turbine and the variable geometry turbocharger including the variable nozzle mechanism according to the present invention, the weight of the entire device can be minimized according to the reduction in weight of the variable nozzle mechanism.

With the variable geometry turbine and the variable geometry turbocharger including the variable nozzle mechanism according to the present invention, the driving force for driving the drive ring is reduced, thus reducing the running costs.

The variable nozzle mechanism according to the present invention provides advantages in that, by reducing the weight of the drive ring, it is possible to reduce the risk of damage when an external force acts, as well as the contact load generated between the inner circumferential surface of the drive ring and the outer circumferential surface of the mount when changing the nozzle blade angle by rotating the drive ring, allowing smooth rotation of the drive ring and reduction in the amount of wear and the driving force.

DETAILED DESCRIPTION OF THE INVENTION

A first embodiment of a variable nozzle mechanism according to the present invention will be described below with reference to FIGS. 1 and 2.

Figure 1:
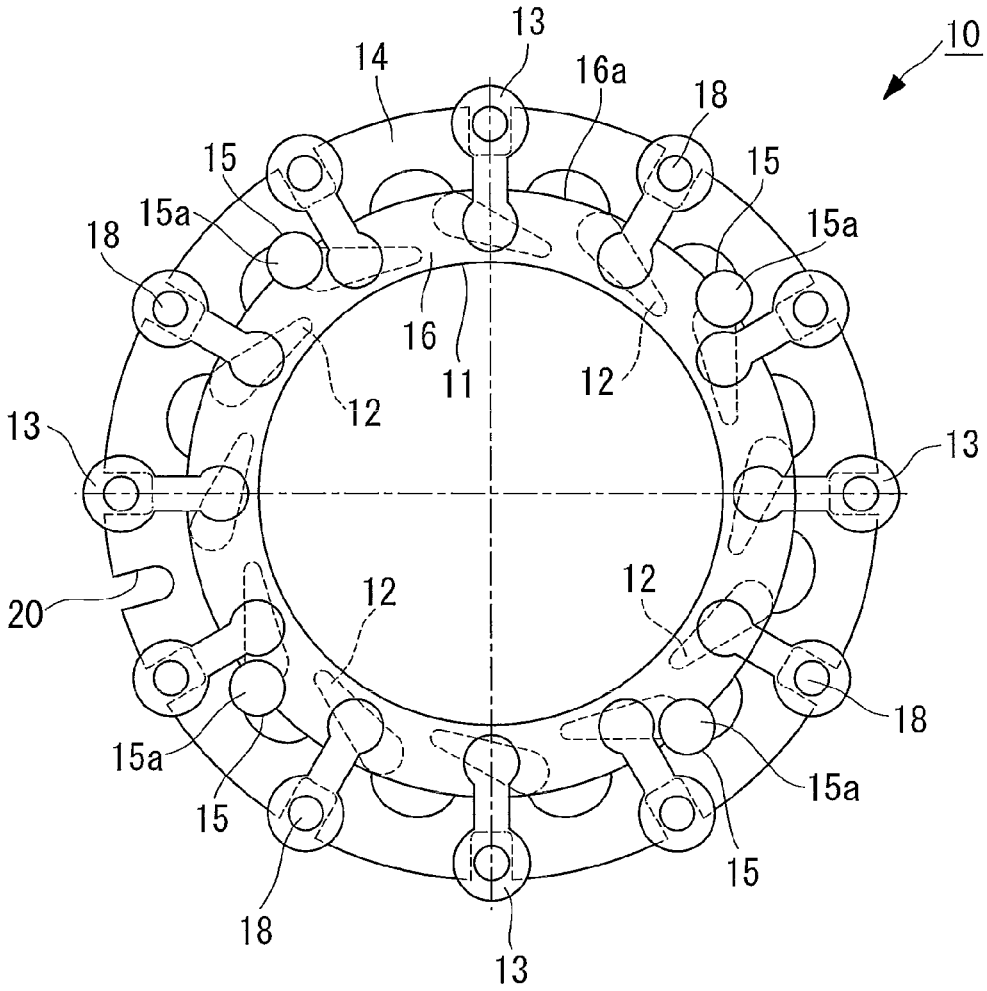
FIG. 1 is a plan view of principal parts of a variable nozzle mechanism according to a first embodiment of the present invention.
Figure 2:
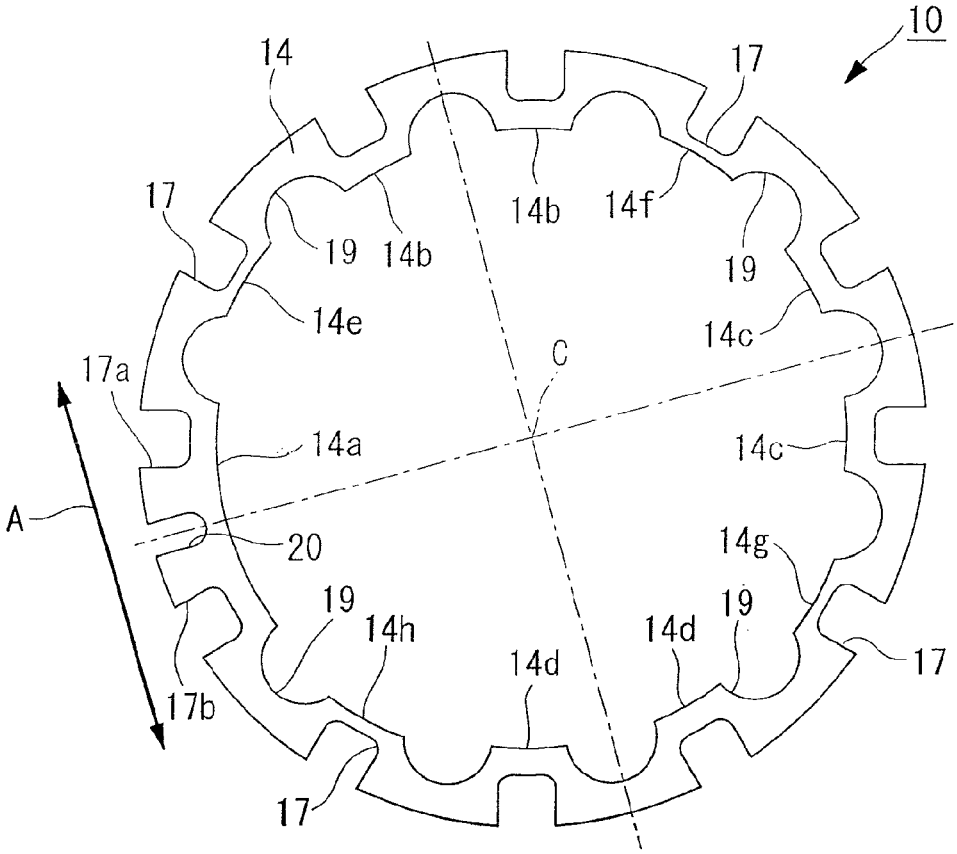
FIG. 2 is a plan view of a drive ring constituting the variable nozzle mechanism according to the first embodiment of the present invention.

FIG. 1 is a plan view of principal parts of the variable nozzle mechanism according to this embodiment, and FIG. 2 is a plan view of a drive ring constituting the variable nozzle mechanism according to this embodiment.

The variable nozzle mechanism has a function of changing a flow speed of combustion gas (fluid) into a turbine rotor by rotating a nozzle to change a nozzle-blade angle and is used in a variable geometry turbine constituting a variable geometry turbocharger (for example, an exhaust-gas turbine-supercharger), not shown in the drawing.

The variable geometry turbocharger includes the variable geometry turbine and a compressor as main components.

The variable geometry turbine and the compressor are connected via a bearing housing, and a turbine rotor rotatably supported by a bearing is inserted into the bearing housing.

The compressor is mainly constituted of a compressor wheel attached to one end of the turbine rotor and a compressor casing provided in such a manner as to surround and cover this compressor wheel.

The variable geometry turbine includes a turbine wheel attached to the other end of the turbine rotor, a turbine casing provided in such a manner as to surround and cover this turbine wheel, and the variable nozzle mechanism that changes the flow speed of the combustion gas flowing into the turbine wheel.

Figure 7A:
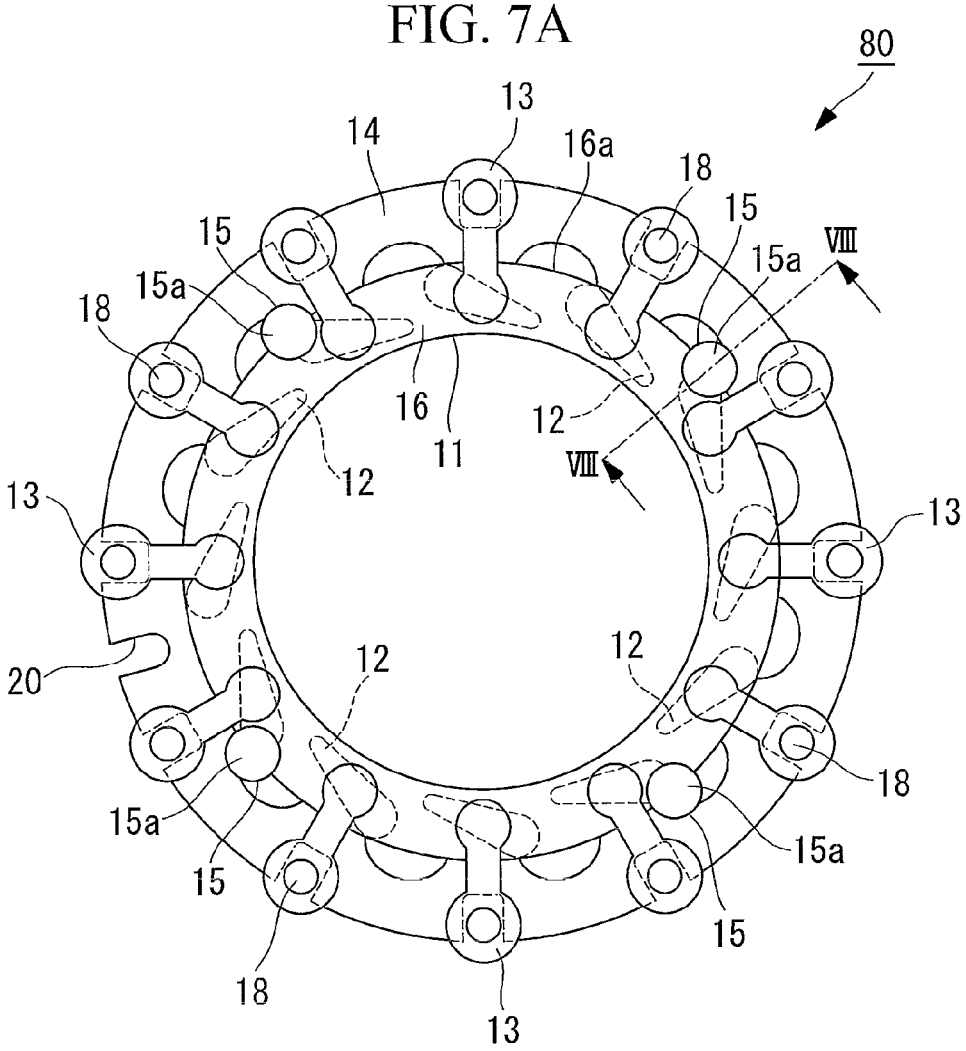
FIG. 7A is a plan view of principal parts, showing a variable nozzle mechanism according to a sixth embodiment of the present invention.
Figure 7B:
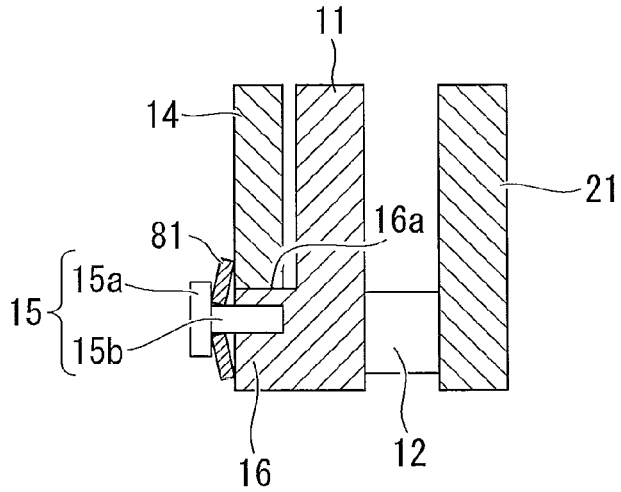
FIG. 7B is a sectional view taken along VII-VII in FIG. 7A, showing the variable nozzle mechanism according to the sixth embodiment of the present invention.

The variable nozzle mechanism 10 according to this embodiment includes a mount 11, vanes 12, lever plates 13, a drive ring 14, stopper pins (rivets) 15, and a plate 21 (see FIG. 7B).

The mount 11 is a plate-shaped member having a ring shape in plan view, and a protruding portion (thick portion) 16 (see FIG. 7B) protruding to one side (proximal side relative to the plane of the FIG. 1) and having a ring shape in plan view is formed at outer rim thereof. In addition, this mount 11 is secured to the bearing housing via fixing means (not shown).

The vanes 12 are disposed at equal intervals in the circumferential direction of the mount 11 (30° intervals in this embodiment) and are attached to the mount 11 in a manner as to be freely rotatable via rotary shafts (pivots), not shown in the drawing.

The lever plates 13 are members used for rotating the vanes 12 about the rotary shafts in accordance with the rotation of the drive ring 14. The rotary shafts of the vanes 12 are connected (coupled) to one end portion of the lever plates 13 (the end portion at the inner side in the radial direction). At the other end portion thereof (the end portion at the outer side in the radial direction), pins 18 that extend towards the other side (distal side relative to the plane of FIG. 1) and that are fitted into first recesses (notches) 17 formed at the outer rim of the drive ring 14 are connected (coupled).

As shown in FIG. 2, the drive ring 14 has a plurality of the first recesses 17 (12 in this embodiment) formed at the outer rim thereof and a plurality of second recesses (notches) 19 (11 in this embodiment) formed at the inner rim thereof.

The first recesses 17 are notches having a substantially square shape in plan view and are disposed at equal intervals (30° intervals in this embodiment) in the circumferential direction. The pin 18 of the corresponding lever plate 13 is fitted in each of the first recesses 17.

In addition, among these first recesses 17, a third recess 20 is formed at an intermediate portion between one of the first recess 17*a* and the other first recess 17*b* adjacent thereto. The third recess 20 is a notch having a substantially rectangular shape in plan view. One end portion of a crankshaft (not shown) for rotating the drive ring 14 in the circumferential direction is fitted in the third recess 20.

In addition, the solid-line arrow A in FIG. 2 shows a moving direction of the crankshaft (i.e., direction in which a driving force acts).

The second recesses 19 are notches (recesses) having a substantially semicircular shape in plan view and are formed, at equal intervals (30° intervals in this embodiment) in the circumferential direction, at intermediate portions between the first recesses 17 and at portions (positions) where the third recess 20 is not formed.

In addition, in this embodiment, an inner circumferential surface 14*a* of the drive ring 14 located at the inner side of the third recess 20 in the radial direction and inner circumferential surfaces 14*b*, 14*c*, and 14*d* of the drive ring 14 formed adjacent to either side of the second recesses 19 that are located at portions (positions) away from the third recess 20 (a portion in which the driving force is applied) at 90°, 180°, and 270° in the circumferential direction (i.e., located on the line that passes through the center of the drive ring and is parallel with the moving direction A of the crankshaft; and located on the line that passes through the center of the drive ring and is orthogonal to the moving direction A of the crankshaft) are provided so as to abut against (contact with) an outer circumferential surface 16*a* of the protruding portion 16 of the mount 11 so as to be rotatable to some extent. In other words, the inner diameters of these inner circumferential surfaces 14*b*, 14*c*, and 14*d* are formed so as to be (substantially) the same as the outer diameter of the outer circumferential surface 16*a*. On the other hand, inner circumferential surfaces 14*e*, 14*f*, 14*g*, and 14*h* of the drive ring 14 located at portions (positions) away from the third recess 20 at 45°, 135°, 225°, and 315° in the circumferential direction are provided in such a manner that they do not abut against (contact with) the outer circumferential surface 16*a* of the protruding portion 16 of the mount 11. In other words, the inner diameters of these inner circumferential surfaces 14*e*, 14*f*, 14*g*, and 14*h* are formed so as to be larger than the inner circumferential surfaces 14*b*, 14*c*, and 14*d* (larger than the outer diameter of the outer circumferential surface 16*a*). As a guideline, among the inner circumferential surfaces of the drive ring 14, the inner diameters located in the regions where a line that passes through the center C of the inner circumferential surface and that is parallel with the action direction (line of action) A of the driving force for rotating the drive ring 14 intersects at an angle of substantially 30° and 60° are preferably formed larger than the inner diameters located in other regions.

In addition, in this embodiment, because the inner circumferential surfaces do not exist at portions away from the third recess 20 at 90°, 180°, and 270° in the circumferential direction, the inner circumferential surfaces 14*b*, 14*c*, and 14*d* of the drive ring 14, which are formed adjacent to either side of the second recesses 19 and which are located away from the third recess 20 at 90°, 180°, and 270° in the circumferential direction, abut against (contact with) the outer circumferential surface 16*a* of the protruding portion 16 of the mount 11. However, when the inner circumferential surfaces exist at portions away from the third recess 20 at 90°, 180°, and 270° in the circumferential direction, the inner circumferential surfaces abut (contact with) against the outer circumferential surface 16*a* of the protruding portion 16 of the mount 11.

Stopper pins 15, which are members used for preventing the drive ring 14 from dropping off from the mount 11, include circular head portions 15*a* and round-rod-like shafts 15*b* (see FIG. 7B). The stopper pins 15 are disposed at equal intervals (90° intervals in this embodiment) in the circumferential direction, and one end of the shafts 15*b* is secured to the mount 11.

With the variable nozzle mechanism 10 according to this embodiment, when the driving force (force for rotating the drive ring 14) is applied to the third recess 20, if the inner diameters of the inner circumferential surfaces 14*e*, 14*f*, 14*g*, and 14*h* of the drive ring 14 become smaller than those of the inner circumferential surfaces 14*a*, 14*b*, 14*c*, and 14*d*, the inner circumferential surfaces 14*e*, 14*f*, 14*g*, and 14*h* of the drive ring 14 contact the mount 11 first. This makes the drive ring 14 pinch the mount 11, and it is thus likely to generate an excessive load. Accordingly, the inner diameters of the inner circumferential surfaces 14*e*, 14*f*, 14*g*, and 14*h* of the drive ring 14, where a contact load with the outer circumferential surface 16*a* of the protruding portion 16 of the mount 11 tends to become high, are formed in such a manner as to be larger than the outer diameter of the outer circumferential surface 16*a*.

In this way, when the drive ring 14 rotates, it is possible to reduce the contact load generated between the inner circumferential surfaces of the drive ring 14 and the outer circumferential surface 16*a* of the protruding portion 16 of the mount 11 and to rotate the drive ring 14 more smoothly, thus reducing the amount of wear and the driving force. In other words, longer life (extended life) of the drive ring 14 and the mount 11 is possible, and the reliability of the entire mechanism (variable nozzle mechanism 10) can be enhanced.

In addition, because a plurality of notches 19 are disposed at the inner rim of the drive ring 14 in the circumferential direction, it is possible to minimize the weight of the drive ring 14 and reduce the risk of damage when an external force acts.

Furthermore, with the variable nozzle mechanism 10 according to this embodiment, because a plurality of the first recesses 17 are formed at the outer rim of the drive ring 14, and a plurality of the second recesses 19 are formed at the inner rim, the weight of the drive ring 14 can be minimized. Accordingly, it is possible to reduce impact load generated when the external force acts due to an impact between parts and also minimize the weight of the entire variable nozzle mechanism 10.

Furthermore, with the variable nozzle mechanism 10 according to this embodiment, because the weight of the drive ring 14 is reduced and the drive ring 14 rotates more smoothly, the driving force for driving the drive ring 14 can be reduced, thus allowing the running costs to be reduced.

With the variable geometry turbine and the variable geometry turbocharger including the variable nozzle mechanism 10 according to this embodiment, because the maintenance or replacement interval of the variable nozzle mechanism 10 can be extended, it is possible to reduce the cost of the entire device (the variable geometry turbine and the variable geometry turbocharger).

In addition, with the variable geometry turbine and the variable geometry turbocharger including the variable nozzle mechanism 10 according to this embodiment, the reliability of the entire device is improved according to the improvement of the reliability of the variable nozzle mechanism 10.

Furthermore, with the variable geometry turbine and the variable geometry turbocharger including the variable nozzle mechanism 10 according to this embodiment, the weight of the entire device can be minimized according to the reduction in weight of the variable nozzle mechanism 10.

Furthermore, with the variable geometry turbine and the variable geometry turbocharger including the variable nozzle mechanism 10 according to this embodiment, because the driving force for driving the drive ring 14 can be reduced, the running cost can also be reduced.

A second embodiment of a variable nozzle mechanism according to the present invention will be described with reference to FIG. 3.

Figure 3:
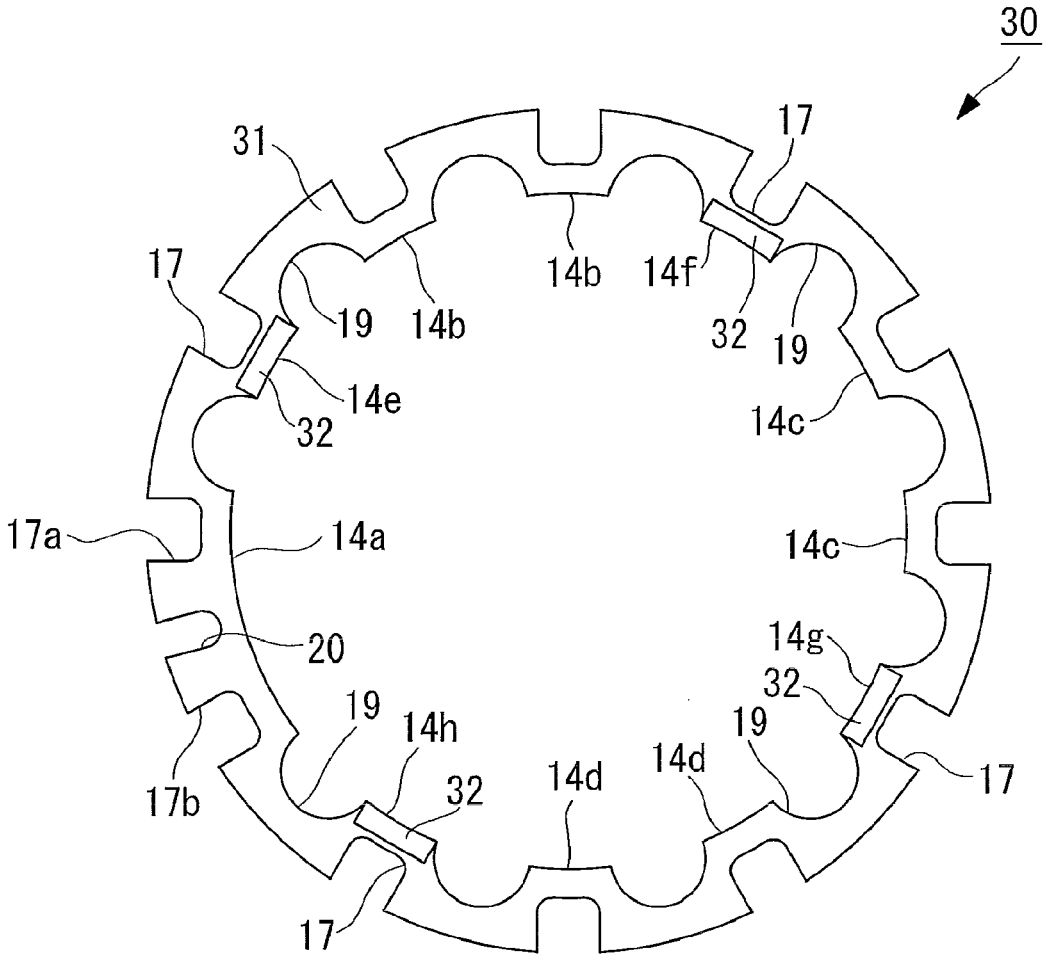
FIG. 3 is a plan view of a drive ring constituting a variable nozzle mechanism according to a second embodiment of the present invention.

As shown in FIG. 3, a variable nozzle mechanism 30 according to this embodiment differs from that according to the first embodiment described above in that, instead of the drive ring 14, a drive ring 31 is provided. Other components are the same as those in the above described first embodiment; therefore, a description thereof is omitted here.

The drive ring 31 has inner circumferential surfaces 14*e*, 14*f*, 14*g*, and 14*h* and other inner circumferential surfaces 14*a*, 14*b*, 14*c*, and 14*d*. Plate thicknesses of portions located between these inner circumferential surfaces 14*e*, 14*f*, 14*g*, and 14*h* and the first recesses 17 are formed so as to be larger than the plate thicknesses located between these inner circumferential surfaces 14*a*, 14*b*, 14*c*, and 14*d* and the first recesses 17, 17*a*, 17*b* and the third recess 20, forming thick portions 32.

Examples of methods for increasing the plate thicknesses include, for example, bending back a portion protruding inward in the radial direction outward in the radial direction, or forming a step when making the drive ring 31.

With the variable nozzle mechanism 30 according to this embodiment, because a stress generated when the impact force acts can be reduced at the thick portions 32, it is possible to reduce the risk of damage to the drive ring 31. Accordingly, the reliability of the entire mechanism (variable nozzle mechanism 30) can be further enhanced.

In addition, in this embodiment, it is more preferable that the stopper pins 15 be provided such that the back surfaces (lower surfaces) of the head portions 15*a* of the stopper pins 15 face the front surfaces (upper surfaces) of the thick portions 32.

With the variable nozzle mechanism 30, gaps between the stopper pins 15 and the drive ring 31 are reduced; therefore, it is possible to reduce the impact force generated when the drive ring 31 collides, as well as the risk of damage to the drive ring 31.

With the variable geometry turbine and the variable geometry turbocharger including the variable nozzle mechanism 30 according to this embodiment, because the impact force of the drive ring 31 caused by vibration is reduced, damage to the drive ring 31 can be prevented, further improving the reliability of the entire mechanism (variable nozzle mechanism 30).

Other advantages are the same as those in the first embodiment described above, and a description thereof is thus omitted.

A third embodiment of a variable nozzle mechanism according to the present invention will be described with reference to FIGS. 4A and 4B.

Figure 4A:
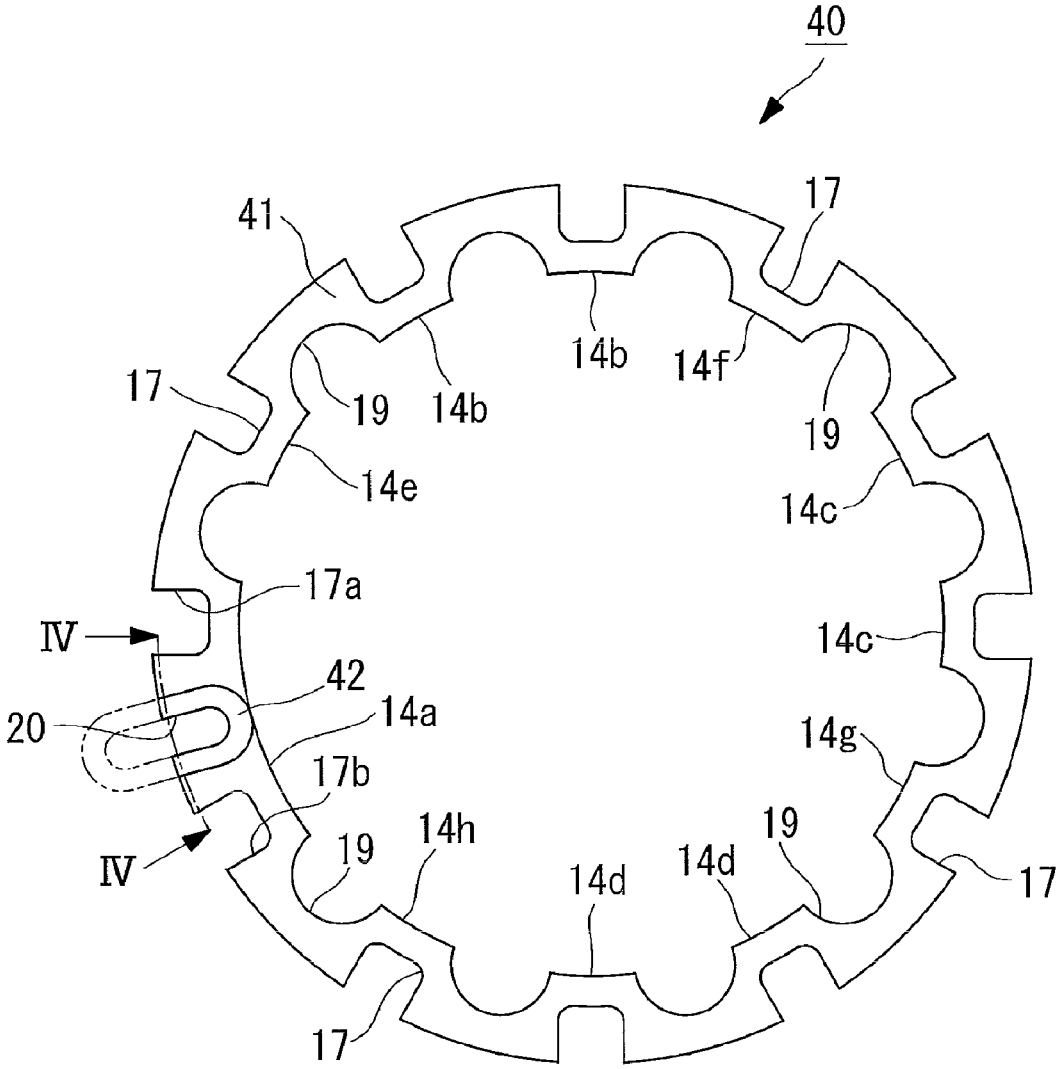
FIG. 4A is a plan view showing a drive ring constituting a variable nozzle mechanism according to a third embodiment of the present invention.
Figure 4B:
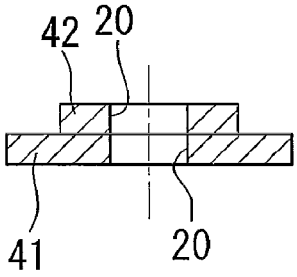
FIG. 4B is a sectional view taken along IV-IV in FIG. 4A, showing the drive ring constituting the variable nozzle mechanism according to the third embodiment of the present invention.

As shown in FIGS. 4A and 4B, a variable nozzle mechanism 40 according to this embodiment differs from that according to the first embodiment described above in that, instead of the drive ring 14, a drive ring 41 is provided. Other components are the same as those in the first embodiment described above; therefore, descriptions thereof are omitted here.

The drive ring 41 has an inner circumferential surface of the third recess 20. The plate thickness of a portion surrounding the third recess 20 is formed so as to be larger than that of other portions, forming a thick portion 42.

Examples of methods for increasing the plate thickness include, for example, bending back a portion protruding outward in the radial direction inward in the radial direction (see FIG. 4A), or forming a step when making the drive ring 41.

With the variable nozzle mechanism 40 according to this embodiment, when rotating the drive ring 41, the plate thickness of a portion which may become worn (expected to be worn) due to contact with one end portion of the crankshaft is designed to be large, thus increasing the contact area. Accordingly, it is possible to reduce the contact load per unit area and the depth of wear of a contact portion contacting with one end portion of the crankshaft. In addition, longer life (extended life) of the drive ring 41 is possible, and the reliability of the entire mechanism (variable nozzle mechanism 40) can be further enhanced.

Other advantages are the same as those in the first embodiment described above, and a description thereof is thus omitted here.

A fourth embodiment of a variable nozzle mechanism according to the present invention will be described with reference to FIGS. 5A and 5B.

Figure 5A:
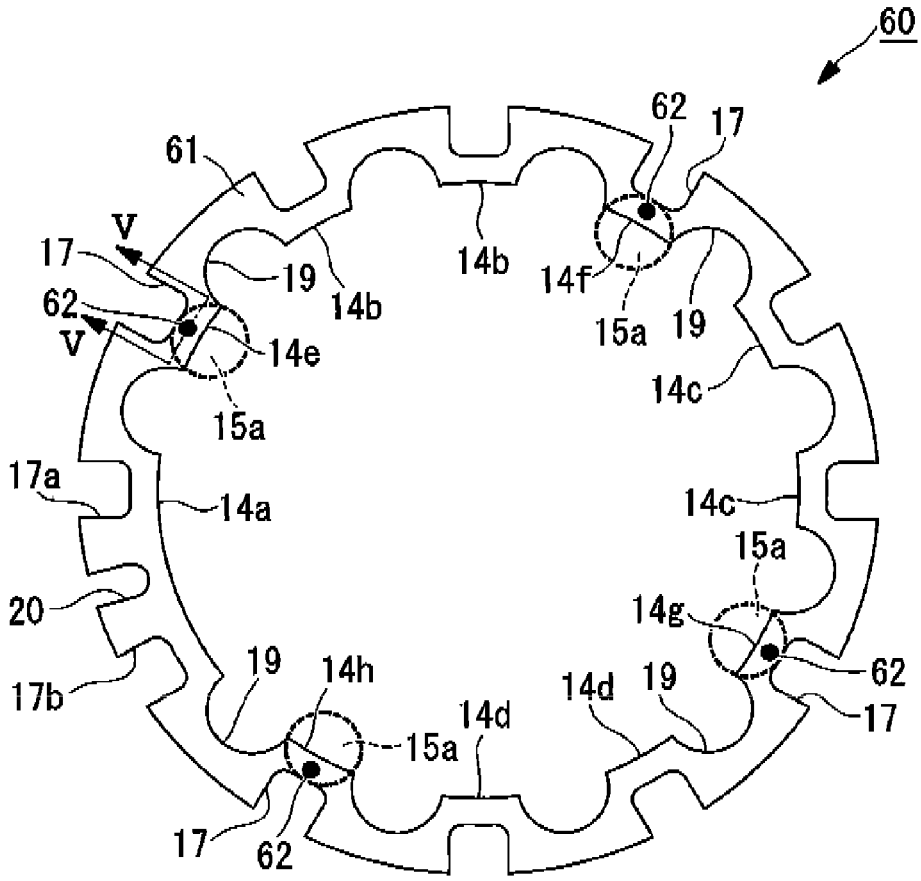
FIG. 5A is a plan view of a drive ring constituting a variable nozzle mechanism according to a fourth embodiment of the present invention.
Figure 5B:
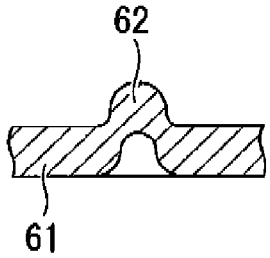
FIG. 5B is a sectional view taken along V-V in FIG. 5A, showing the drive ring constituting the variable nozzle mechanism according to the fourth embodiment of the present invention.

As shown in FIGS. 5A and 5B, a variable nozzle mechanism 60 according to this embodiment differs from that according to the first embodiment described above in that, instead of the drive ring 14, a drive ring 61 is provided. Other components are the same as those in the first embodiment described above; therefore, a description thereof is omitted here.

The drive ring 61 has inner circumferential surfaces 14*e*, 14*f*, 14*g*, and 14*h*. Protruding portions 62 are provided at portions located between these inner circumferential surfaces 14*e*, 14*f*, 14*g*, and 14*h* and the first recesses 17. The protruding portions 62 have, for example, a semicircular shape with a diameter of approximately 1 mm to 3 mm and are formed so as to protrude from the back surface (lower surface) side.

In this embodiment, the stopper pins 15 are provided such that the back surfaces (lower surfaces) of the head portions 15*a* of the stopper pins 15 face the front surfaces (upper surfaces) of the protruding portions 62 and also abut against (contact with) each other.

With this variable nozzle mechanism 60, it is possible to reduce the impact force generated when the drive ring 61 collides, as well as the risk of damage to the drive ring 61.

With the variable geometry turbine and the variable geometry turbocharger including the variable nozzle mechanism 60 according to this embodiment, because the impact force of the drive ring 61 caused by vibration is reduced, damage to the drive ring 61 can be prevented, further improving the reliability of the entire mechanism (variable nozzle mechanism 60).

Other advantages are the same as those in the first embodiment described above, and a description thereof is thus omitted here.

A fifth embodiment of a variable nozzle mechanism according to the present invention will be described with reference to FIGS. 6A and 6B.

Figure 6A:
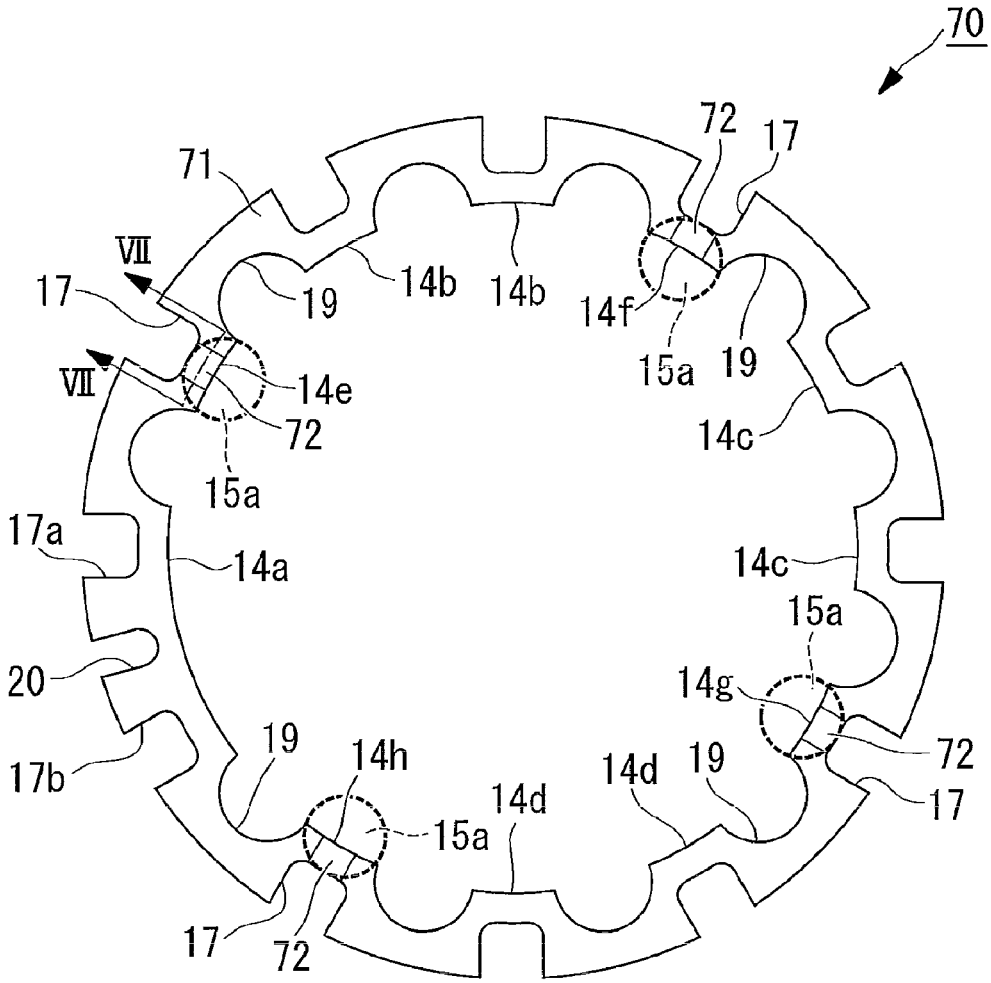
FIG. 6A is a plan view showing a drive ring constituting a variable nozzle mechanism according to a fifth embodiment of the present invention.
Figure 6B:
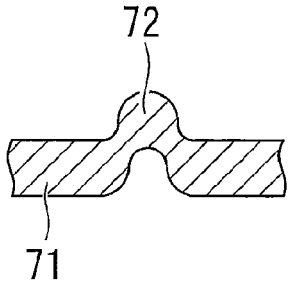
FIG. 6B is a sectional view taken along VI-VI in FIG. 6A, showing the drive ring constituting the variable nozzle mechanism according to the fifth embodiment of the present invention.

As shown in FIGS. 6A and 6B, a variable nozzle mechanism 70 according to this embodiment differs from that according to the first embodiment described above in that, instead of the drive ring 14, a drive ring 71 is provided. Other components are the same as those in the first embodiment described above; therefore, descriptions thereof are omitted here.

The drive ring 71 has inner circumferential surfaces 14*e*, 14*f*, 14*g*, and 14*h* and has protruding portions 72 at portions located between these inner circumferential surfaces 14*e*, 14*f*, 14*g*, and 14*h* and the first recesses 17. The protruding portions 72 have, for example, a mountain shape in cross-sectional view with a height of approximately 1 mm to 3 mm shown in FIG. 6B, and are formed so as to protrude from the back surface (lower surface) side (or, by bending (curving) portions located between the inner circumferential surfaces 14*e*, 14*f*, 14*g*, and 14*h* and the first recesses 17).

In this embodiment, the stopper pins 15 are provided such that the back surfaces (lower surfaces) of the head portions 15*a* of the stopper pins 15 face the front surfaces (upper surfaces) of the protruding portions 72 and abut against (contact with) each other.

With this variable nozzle mechanism 70, it is possible to reduce the impact force generated when the drive ring 71 collides, as well as the risk of damage to the drive ring 71.

With the variable geometry turbine and the variable geometry turbocharger including the variable nozzle mechanism 70 according to this embodiment, because the impact force of the drive ring 71 caused by vibration is reduced, damage to the drive ring 71 can be prevented, further improving the reliability of the entire mechanism (variable nozzle mechanism 70).

Other advantages are the same as those in the first embodiment described above, and a description thereof is thus omitted here.

A sixth embodiment of a variable nozzle mechanism according to the present invention will be described with reference to FIGS. 7A and 7B.

As shown in FIGS. 7A and 7B, a variable nozzle mechanism 80 according to this embodiment differs from that according to the fourth and the fifth embodiments described above in that, instead of the protruding portions 62 and 72, impact absorbing members (elastic members) 81 are provided between the back surfaces (lower surfaces) of the head portions 15*a* of the stopper pins 15 and both the front surface (upper surface) of the drive ring 14 and the front surface (upper surface) of the protruding portion 16 of the mount 11. Other components are the same as those in the fourth and the fifth embodiments described above; therefore, a description thereof is omitted here.

For example, conical disc springs or washers may be used for the impact absorbing members 81. In addition, when using washers for the impact absorbing members 81, it is more preferable to use those made of a soft material such as exfoliated graphite.

With the variable nozzle mechanism 80 according to this embodiment, no processing (for example, extrusion molding) of the portions located between the inner circumferential surfaces 14*e*, 14*f*, 14*g*, and 14*h* and the first recesses 17 is required, thus simplifying the manufacturing process and reducing the manufacturing costs.

Other advantages are the same as those in the fourth and the fifth embodiments, and a description thereof is thus omitted here.

A seventh embodiment of a variable nozzle mechanism according to the present invention will be described.

A variable nozzle mechanism according this embodiment differs from that according to the fourth and the fifth embodiments in that surface hardening is performed on the entire front surfaces of protruding portions 62 and 72 and/or the back surfaces (lower surfaces) of the head portions 15*a* of the stopper pins 15. Other components are the same as those in the fourth and the fifth embodiments described above. Therefore, descriptions thereof are omitted here.

Nitride PVD (Physical Vapor Deposition) coating, such as chromium nitride (CrN) coating, having excellent thermal-resistance may be used for surface hardening.

With the variable nozzle mechanism according to this embodiment, scratches can be prevented from being generated on the front surfaces of the protruding portions 62 and 72 and/or the back surfaces of the head portions 15*a*.

In addition, because the wear resistance of the drive rings 61 and 71 and the stopper pins 15 can be improved, longer life (extended life) of the drive rings 61 and 71 and the stopper pins 15 is possible, further improving the reliability of the entire mechanism (variable nozzle mechanisms 60 and 70).

Other advantages are the same as those in the fourth and the fifth embodiments described above, and a description thereof is thus omitted here.

The present invention is not restricted to the embodiments described above. Suitable modifications, changes, and combinations can be made so long as they do not depart from the spirit of the present invention.

What is claimed is:

1. A variable nozzle mechanism for changing a flow speed of fluid into a turbine rotor by rotating nozzles to change a nozzle-blade angle, comprising:

a drive ring that is supported by a mount secured to a bearing housing configured to support the turbine rotor and that rotates relative to the mount while some inner circumferential surfaces abut against a portion of an outer circumferential surface of the mount, wherein a plurality of notches in a circumferential direction are provided at an inner rim of the drive ring, among the inner circumferential surfaces located between the notches, when a driving force for rotating the drive ring is applied, an inner diameter in a region where a contact load with the outer circumferential surface tends to become large is made larger than an inner diameter of other inner circumferential surfaces, the inner circumferential surface of the region where the contact load tends to become large does not abut against the outer circumferential surface, and a protruding portion that abuts against a head portion of a stopper pin for preventing the drive ring from dropping off from the mount is provided in the region where the contact load with the outer circumferential surface tends to become large.

2. A variable nozzle mechanism according to claim 1, wherein the region where the contact load with the outer circumferential surface tends to become large is a region that passes through the center of the inner circumferential surfaces and that does not intersect with a line substantially parallel with a line of action of the driving force for rotating the drive ring, as well as a region that passes through the center of the inner circumferential surfaces and that does not intersect with a line substantially orthogonal to the line of action of the driving force for rotating the drive ring.

3. A variable nozzle mechanism according to claim 1, wherein a thick portion for increasing the plate thickness is provided in a peripheral region of a portion to which the driving force is applied.

4. A variable nozzle mechanism according to claim 1, wherein an impact absorbing member is provided between the head portion of the stopper pin and both the drive ring and the mount.

5. A variable nozzle mechanism according to claim 1, wherein surface hardening is performed on a front surface of the protruding portion and/or the entire back surface of the head portion of the stopper pin.

6. A variable nozzle mechanism according to claim 1, wherein the plurality of notches or a plurality of through holes for receiving lever plates that manipulate the nozzle-blade angle of the nozzles are provided at the outer rim of the drive ring in the circumferential direction.

7. A variable nozzle mechanism for changing a flow speed of fluid into a turbine rotor by rotating nozzles to change a nozzle-blade angle, comprising:

a drive ring that is supported by a mount secured to a bearing housing configured to support the turbine rotor and that rotates relative to the mount while some inner circumferential surfaces abut against a portion of an outer circumferential surface of the mount, wherein a plurality of notches in a circumferential direction are provided at an inner rim of the drive ring, among the inner circumferential surfaces located between the notches, when a driving force for rotating the drive ring is applied, an inner diameter in a region where a contact load with the outer circumferential surface tends to become large is made larger than an inner diameter of other inner circumferential surfaces, the inner circumferential surface of the region where the contact load tends to become large does not abut against the outer circumferential surface, and a thick portion for increasing a plate thickness is provided in the region where the contact load with the outer circumferential surface tends to become large.

8. A variable geometry turbocharger comprising a variable nozzle mechanism for changing a flow speed of fluid into a turbine rotor by rotating nozzles to change a nozzle-blade angle, said variable nozzle mechanism comprising:

a drive ring that is supported by a mount secured to a bearing housing configured to support the turbine rotor and that rotates relative to the mount while some inner circumferential surfaces abut against a portion of an outer circumferential surface of the mount, wherein a plurality of notches in a circumferential direction are provided at an inner rim of the drive ring, among the inner circumferential surfaces located between the notches, when a driving force for rotating the drive ring is applied, an inner diameter in a region where a contact load with the outer circumferential surface tends to become large is made larger than an inner diameter of other inner circumferential surfaces, the inner circumferential surface of the region where the contact load tends to become large does not abut against the outer circumferential surface, and a protruding portion that abuts against a head portion of a stopper pin for preventing the drive ring from dropping off from the mount is provided in the region where the contact load with the outer circumferential surface tends to become large.

* * * * *